United States Patent [19]

Braun

[11] 4,111,609

[45] Sep. 5, 1978

[54] MULTISTAGE GAS COMPRESSOR

[76] Inventor: Anton Braun, 6421 Warren Ave., Edina, Minn. 55435

[21] Appl. No.: 812,687

[22] Filed: Jul. 5, 1977

Related U.S. Application Data

[63] Continuation of Ser. No. 624,846, Oct. 28, 1975, abandoned.

[51] Int. Cl.[2] ..... F04B 23/06

[52] U.S. Cl. ..... 417/243; 417/254; 417/267

[58] Field of Search ..... 417/243, 254, 267

[56] References Cited

U.S. PATENT DOCUMENTS

| | | | |
|---|---|---|---|
| 938,004 | 10/1904 | Leyner | 417/243 |
| 1,158,030 | 10/1915 | Dechamps | 417/243 |
| 1,668,099 | 5/1928 | Wintzer | 417/243 |
| 2,241,957 | 5/1941 | Pescara | 417/266 |
| 2,765,976 | 10/1956 | Steuart | 417/243 |
| 2,885,963 | 5/1959 | Ivanoff | 417/372 |
| 3,861,223 | 1/1975 | Braun et al. | 74/44 |

*Primary Examiner*—Carlton R. Croyle

*Assistant Examiner*—R. E. Gluck

*Attorney, Agent, or Firm*—Alan M. Staubly

[57] ABSTRACT

A compact fluid compressor embodying a housing formed of a plurality of stacked sections with relatively large fluid flow passageways cast therein and wherein the overall outline of the compressor's housing is substantially rectangular. This arrangement eliminates numerous external piping and the connections needed therefor, found in prior art compressors, and provides a lightweight and good appearing compressor as well as a highly efficient one. The small size, considering the horse power thereof, is due in part to the utilization therein of the Braun mechanism, a counterbalancing and anti-vibration drive mechanism between the power means and the compressor piston or pistons, which mechanism is fully disclosed in Braun U.S. Pat. No. 3,861,222. Even in the two-stage embodiment of the compressor, an inter-cooler, an after-cooler and an inlet fluid (air) filter lie within the above-mentioned outline. Cavities in the housing adjacent to the Braun mechanism enable the strong housing to serve the dual function of walls for the mechanism and walls for the cooling means.

5 Claims, 5 Drawing Figures

38
44
45
37a
37
44
45
36
44
45
35
41
40
14
39
33
34
3
3
18
41
40
32
41
40
43
42
29
46
11
28
21
23
24
22
27
13
31
30
47
17
20
27a
19
16
26
25
15
12
18a

MULTISTAGE GAS COMPRESSOR

This application is a continuation of my application for a compressor, Ser. No. 625,846, filed Oct. 28, 1975, now abandoned.

Fluid compressors requiring cooling means for fluids that have been compressed are generally well known in the art. Janicke U.S. Pat. No. 3,200,249 discloses a cooler 15 between a first-stage compression cylinder and a second-stage compression cylinder, while Pescara U.S. Pat. No. 2,241,957 discloses coolers $C_1$ and $C_2$ between first and second-stage cylinders and between second and third-stage cylinders. It is to be noted, however, that in each of these patents the cooler or coolers are separate from the compressor and are connected thereto by means of pipes extending from the general outline of the compressor.

Compressors manufactured by Bernard, type numbers 6 Bm 230 and 6 Bb 230, embody single-acting compressors, with air coolers, wherein a plurality of compressor cylinders are arranged on V-shaped axes. It is to be noted that these compressors do not have counterbalanced and anti-vibration driving means between the crankshaft and the compressor pistons. Nor do they have an entire compressor that is compact and of a generally rectangular shape or outline. The cooling means are also located along the sides of the compressors cylinders which make both banks of compressors quite large. The coolers do not have to withstand very high pressures so consequently are not presented with the problem of providing strong walls for the compressed air therein.

In the present invention, the extra weight and, therefore, the extra cost of having separate and heavy cooling containers, which must be strong enough to withstand high pressures, is eliminated, without the loss of their functions. Cavities are formed in the compressor's reinforced housing on opposite sides of the Braun mechanism, each of which with a cover plate forms a strong container for a cooling coil or a filter. Due to the substantially vibrationless operation of the invention, cooling coils mounted on the cover plate are not subjected to damaging vibration. By forming passageways in the housing to and from the cavities, the cost of external coupling pipes is also saved. Furthermore, the above features of the invention substantially reduces the noise level and provides a very compact compressor that has a pleasing appearance as compared to the large and unattractive prior art arrangements.

FIG. 1 of the drawing is a side elevational view of the invention with parts thereof broken away;

Figure 1:
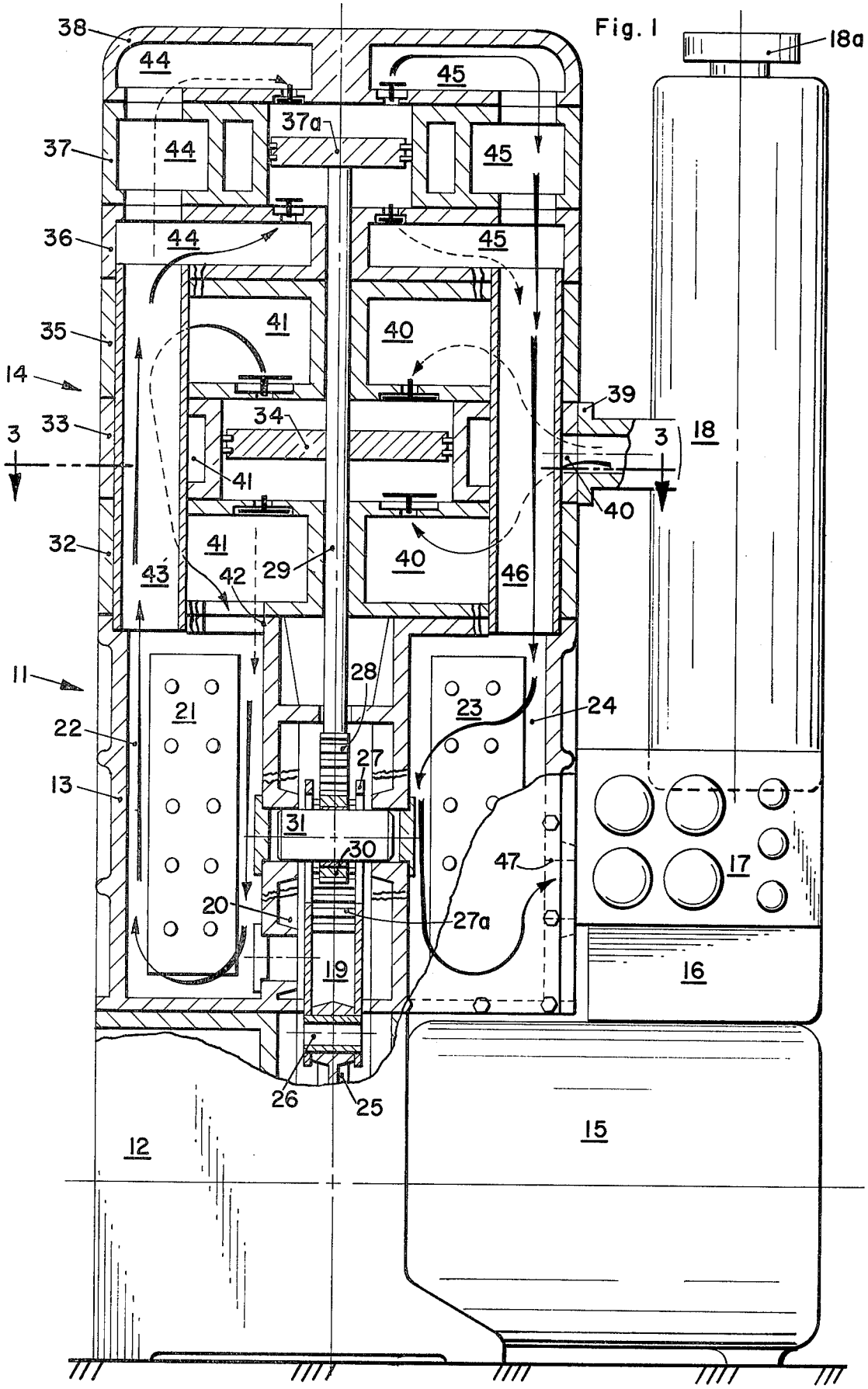
Figure 2:
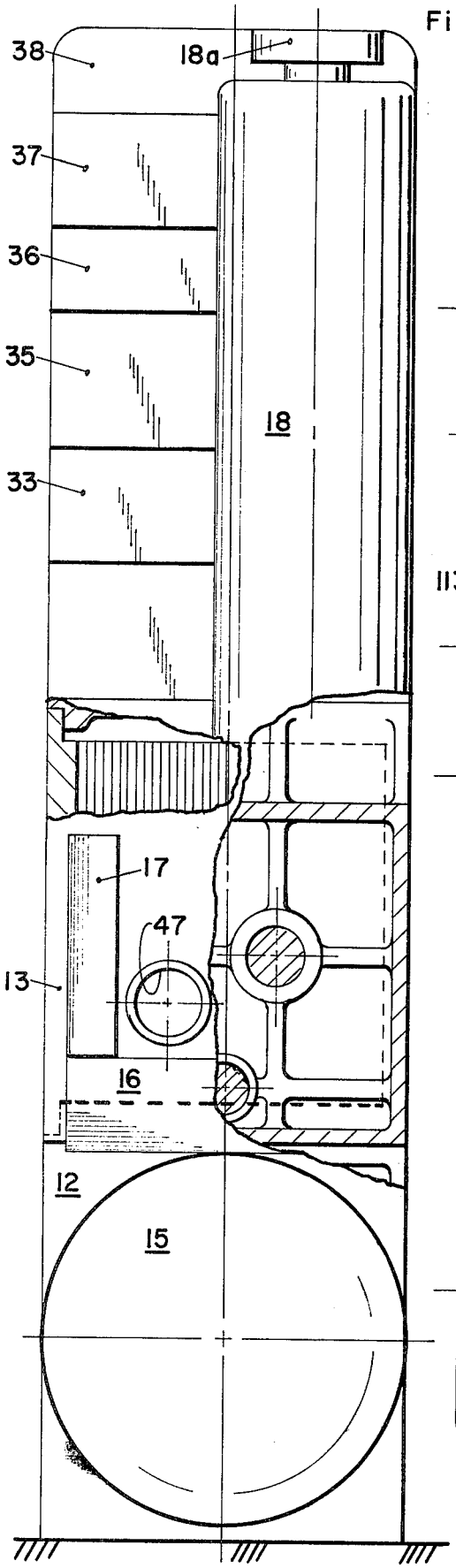
FIG. 2 is a rear view of the invention with portions thereof broken away.
Figure 3:
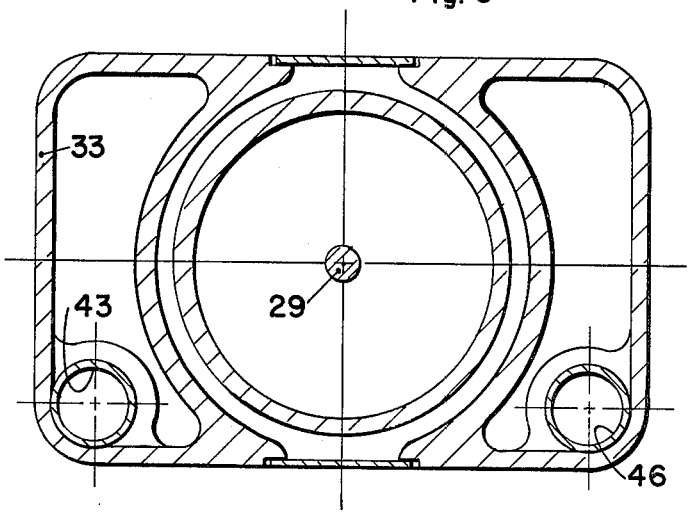
FIG. 3 is a sectional view of the compressor portion of one embodiment of the invention, taken along line 3—3 of FIG. 1.

The reference numeral 11 designates the entire housing of the compressor which includes a base section 12, an intermediate section 13 and a compressor section generally designated by the numeral 14. While the compressor may be used to compress various fluids, it will be described herein as an air compressor. The sections 13 and 14 have portions that partly overlie a motor or other power means 15 while an electrical box 16, control panel 17 and an air or other fluid inlet filter 18 overlie the other portion of the motor. All of the above mentioned components lie in a generally rectangular outline.

Base section 12 houses a crankshaft (not shown) connected to motor 15 and to a lubrication pump (not shown).

Section 13 encloses a Braun mechanism 19 in central chamber 20, an inter-cooler 21 in chamber 22 and an after-cooler 23 in chamber 24. A connecting rod 25 is connected by a pin 26 to a counterbalancing member 27 having two spaced and parallel rack portions **27*a*. A centrally disposed double rack member 28 extends between and in spaced relationship with respect to rack portions 27*a* and has a piston rod 29 extending therefrom into section 14. A pair of pinion gears 30 are mounted on fixed pivot pins 31, one each between the inner and outer rack members so that as the connecting rod and counter balancing member 27** move downwardly, the double rack and piston rod move upwardly, all as explained in detail in my U.S. Pat. No. 3,861,222.

Section 14 is made up of a plurality of subsections including a first stage cylinder head section 32 having inlet and outlet check values, a first stage cylinder section 33 with a first stage piston 34 therein connected to piston rod 29, another first stage cylinder head section 35 with inlet and outlet check valves therein, a second stage cylinder head section 36 with inlet and outlet check valves, therein, a second stage cylinder section 37 with a second stage piston **37*a* therein connected to rod 29, and another second stage cylinder head 38** with inlet and outlet check valves.

Filter 18 has an inlet **18*a* and an outlet coupling 39 for conducting air into an air inlet chamber 40 in sections 32, 33 and 35. An air outlet chamber 41 has a fluid flow connection with inter-cooler chamber 22 through opening 42. A conduit or sectionally molded passageway 43 extends from chamber 22 to chamber 44 in sections 36, 37 and 38. Air is exhausted from the second stage cylinder into outlet chamber 45 in sections 36, 37 and 38 and from there through conduit or molded passageway 46 to after-cooler chamber 24 and to an outlet 47. A second radially spaced pipe (not shown) may also be inserted into either or both of conduits 43 and 46 to prevent heating of the intercooled air on its way to chamber 44 or of the inlet air on its way to chamber 40**, respectively.

In the operation of the invention, fluid, such as air, is caused to be drawn through filter 18 into chamber 40 by the reciprocating action of piston 34 by means of motor 15 and Braun mechanism 19, as described above. The elements of the invention are illustrated in the positions they assume as the pistons approach their uppermost positions, with the double rack moving upwardly and the outer racks and connecting rod moving downwardly. Air is thereby forced through the inter-cooler to the second stage compressor and from the second stage compressor through the after-cooler to the outlet from the compressor.

Figure 4:
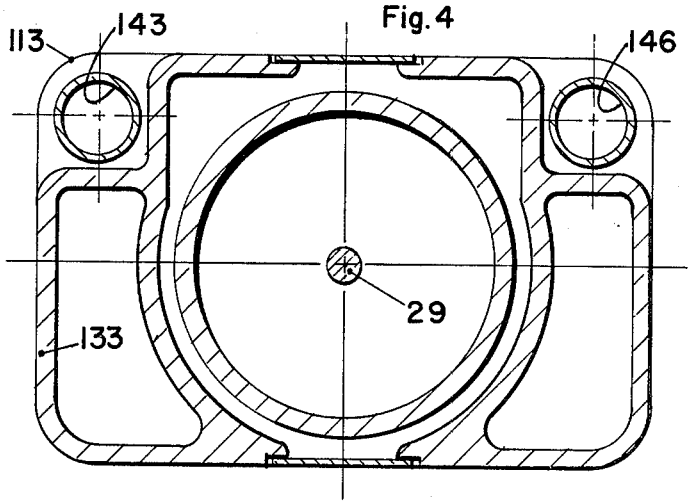
FIG. 4 is a sectional view similar to FIG. 3 of a compressor portion of another embodiment.

The modification of FIG. 4 merely shows alternate positions for the air conducting passageways, they being designated by the reference numerals 143 and 146 entering section 113.

Figure 5:
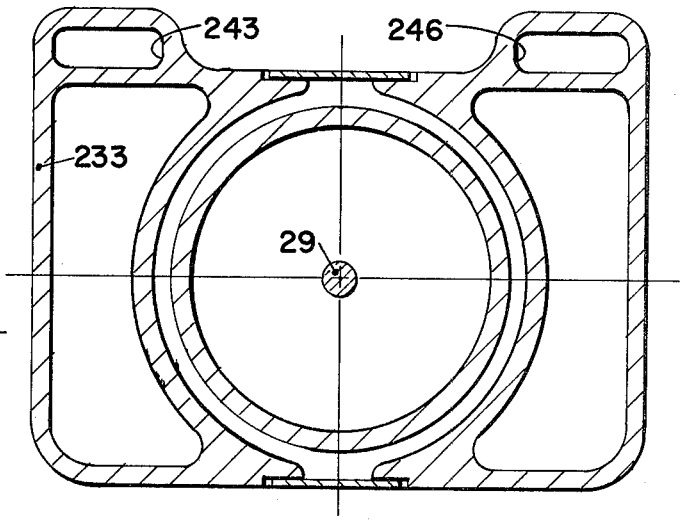
FIG. 5 is a sectional view similar to FIG. 3 of a still further embodiment.

In the FIG. 5 modification, the passageways 243 and 246 are molded as parts of section 233 and the other sections corresponding to sections 13, 32, 35, 36, 37 and 38 of FIG. 1.

Obviously, the compressor sections may have other shapes and locations for the air passageways and still perform the desired functions. For example the second stage sections may be reduced in size and one or more of the air flow passageways be located in a different place or places. Passageways corresponding to passageways 43 and 46 may both be located at the narrow side of the compressor.

If only a single-stage, double-acting compressor is needed, one of the cooler cavities could be used to house a modified inlet air filter, which would replace filter 18. This would only require a slight rearrangement of the air flow passageways.

It is thus seen that all of the functioning of prior art compressors is accomplished by the present invention which is more compact, lighter in weight, embodies fewer parts, is less expensive and has a much more pleasing appearance than prior art compressors of the same capacity.

I claim:

1. A compact multistage gas compressor comprising a substantially box-shaped housing, a plurality of stacked housing sections of substantially equal cross-sectional areas and with axially aligned first and second compressor cylinders therein, pistons in said cylinders for compressing gas in said cylinders, power-driven actuating means in said housing axially spaced from and for operating said pistons, driving means between said actuating means and said pistons, first and second high-pressure gas receiving chambers alongside of and on opposite sides of said driving means, each of said chambers having a single and strong partition wall between it and said driving means, a gas inlet in said housing leading to said first cylinder, a relatively large first gas passageway in said housing extending between said first cylinder and said first chamber, a relatively large second gas passageway extending through axially aligned openings in said housing sections between said first chamber and said second cylinder, a relatively large third gas passageway extending from said second cylinder through axially aligned openings in said housing sections to said second chamber, an outlet from said second chamber, and liquid-type cooling units mounted in each of said chambers.

2. A gas compressor as defined in claim 1 wherein said second and third passageways are on opposite sides of said first cylinder.

3. A gas compressor as defined in claim 1 wherein each of said cylinders has an inlet valve and an outlet in each end wall thereof with passageways leading to each valve cast in said housing.

4. A gas compressor as defined in claim 1 in combination with power means for actuating said driving means and wherein a portion of said power means is positioned below one of said chambers.

5. A gas compressor as defined in claim 4 in combination with an air inlet filter positioned at one side of said cylinders and above another portion of said power means.

* * * * *